US007501987B2

(12) United States Patent
Wang et al.

(10) Patent No.: US 7,501,987 B2
(45) Date of Patent: Mar. 10, 2009

(54) TRIPLE-BAND ANTENNA AND ELECTRONIC DEVICE THEREOF

(75) Inventors: Chih-Ming Wang, Taipei Hsien (TW); Yi-Ling Chiu, Taipei Hsien (TW)

(73) Assignee: Wistron Neweb Corp., Taipei Hsien (TW)

( * ) Notice: Subject to any disclaimer, the term of this patent is extended or adjusted under 35 U.S.C. 154(b) by 0 days.

(21) Appl. No.: 11/979,318

(22) Filed: Nov. 1, 2007

(65) Prior Publication Data

US 2008/0309563 A1 Dec. 18, 2008

(30) Foreign Application Priority Data

Jun. 14, 2007 (TW) ..... 96121598 A

(51) Int. Cl.
*H01Q 1/24* (2006.01)

(52) U.S. Cl. ..... 343/702; 343/700 MS

(58) Field of Classification Search ..... 343/702, 343/700 MS

See application file for complete search history.

(56) References Cited

U.S. PATENT DOCUMENTS

2003/0206136 A1* 11/2003 Chen ..... 343/702
2004/0233109 A1* 11/2004 Ying et al. ..... 343/700 MS
2005/0122267 A1* 6/2005 Sim et al. ..... 343/702
2007/0222688 A1* 9/2007 Sugiyama ..... 343/702

* cited by examiner

*Primary Examiner*—Don P Le
(74) *Attorney, Agent, or Firm*—Bacon & Thomas, PLLC

(57) ABSTRACT

A triple-band antenna for an electronic device with a communication capability comprises a first radiating body, a second radiating body, a metal base and a signal feed source. A dual-band antenna for low frequency and high frequency bands may be formed by the first radiating body. A middle-frequency band antenna and a balun may be formed by the combination of the first radiating body and the second radiating body, and the balun may be used to increase the bandwidth of operating frequencies of the intermediate frequency band antenna.

25 Claims, 12 Drawing Sheets

TRIPLE-BAND ANTENNA AND ELECTRONIC DEVICE THEREOF

BACKGROUND OF THE INVENTION

1. Field of the Invention

The present invention relates an antenna, and, more particularly, to a triple-band antenna for different frequency bands, which is designed for an increased low frequency bandwidth and different intermediate frequency bandwidths.

2. Description of the Related Art

With the rapid growth of wireless communication technologies, standard signal frequency antennas are now insufficient, and so multiple frequency antennas have become the technology of choice. A multiple frequency antenna is usually used in a portable electronic device that supports wireless communication functions, such as a notebook, a mobile phone or a PDA. Since these electronic devices are all very thin and light, it is necessary to have small-volume multiple frequency antennas. However, usually when the antenna has a smaller volume, its reception efficiency is also reduced, and multiple frequency antennas may have narrow frequency bandwidths at different frequency locations. Therefore, the design needs to compromise between volume and reception efficiency. Moreover, the standard multiple frequency antenna with an intermediate frequency band reception ability may also fail to have a broadband response due to the design.

It is therefore desirable to provide a triple-band antenna to mitigate and/or obviate the aforementioned problems.

SUMMARY OF THE INVENTION

A main objective of the present invention is to provide a triple-band antenna, which has design for increasing low frequency bandwidth and capable of receiving high frequency band and intermediate frequency band signals at the same time.

Another objective of the present invention is to provide a triple-band antenna having a balun, so the intermediate frequency antenna can have broadband response.

In order to achieve the above mentioned objectives, the triple-band antenna of the present invention comprises a first radiating body, a second radiating body and a signal feed source. The first radiating body comprises a first metal element, a first radiating unit, a first connecting element and a first grounded wall, the first metal element comprising a feed point, the first metal element being connected to the first radiating unit, the first radiating unit substantially extends along a first direction, one end of the first connecting element is connected to the first metal element, and the other end is connected to the first grounded wall. The first radiating unit comprises a second metal element, a third metal element and a fourth metal element. With the first metal element, the second metal element and the third metal element form a dual-band antenna for low frequency and high frequency bands. The second radiating body partially overlaps the first radiating body and has no contact thereto. The second radiating body comprises a second radiating unit, a second connecting element, a grounded connecting element and a second grounded wall. The second radiating unit comprises a fifth metal element and a sixth metal element and substantially extends along a second direction. With the first metal element, the fourth metal element, the fifth metal element and the sixth metal element form a broadband antenna for the intermediate frequency band.

In order to achieve the above mentioned objectives, the triple-band antenna of the present invention further comprises a third grounded wall, one end of the third grounded wall and a metal base are substantially perpendicularly connected with each other, and the second connecting element extends along the second direction and is connected to another end of the third grounded wall. With the first connecting element, the first grounded wall, the second connecting element, the grounded connecting element and the third grounded wall form a balun for an intermediate frequency band via a connection provided by the signal feed source. With the balun, the impedance of the intermediate frequency dipole antenna and the sub-intermediate frequency near dipole antenna can be adjusted to increase the frequency band to provide the functionality of an intermediate frequency broadband antenna. The second radiating body, the first metal element, the fourth metal element, the first connecting element and the first grounded wall form a near dipole broadband antenna for the intermediate frequency band with the balun, which provides an adjustable impedance for increasing the frequency band via the balun.

Other objects, advantages, and novel features of the invention will become more apparent from the following detailed description when taken in conjunction with the accompanying drawings.

DETAILED DESCRIPTION OF THE PREFERRED EMBODIMENT

Figure 1A:
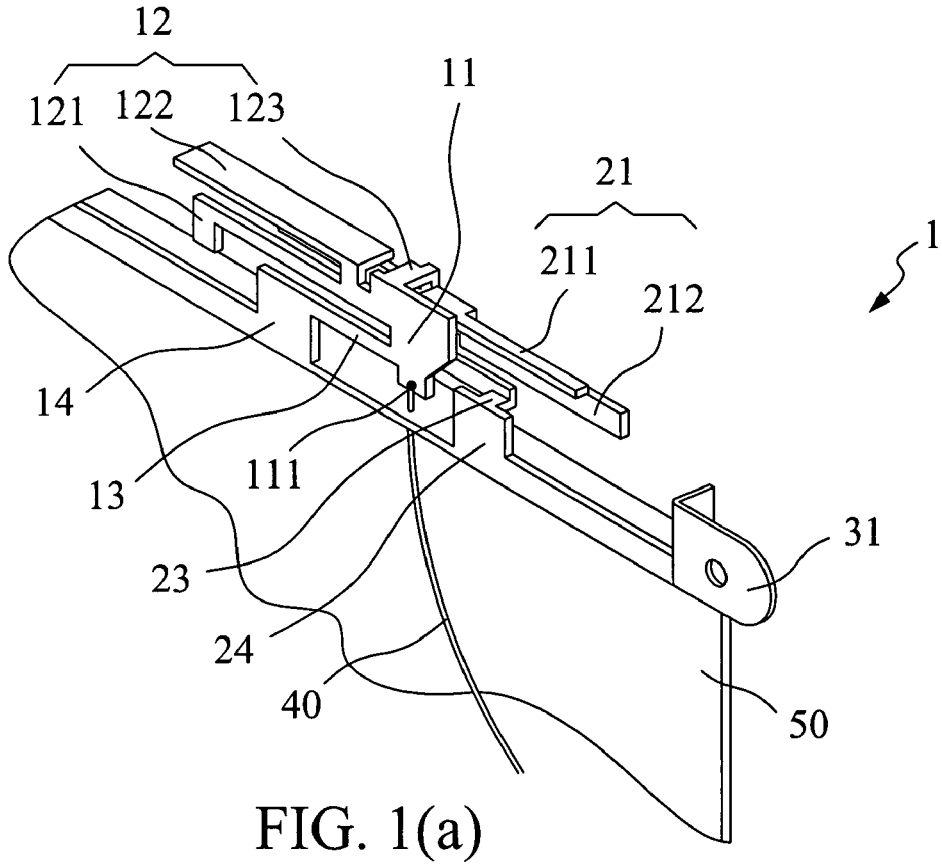
FIGS. 1(*a*), (*b*) are front and back view drawings of a first embodiment of the present invention.
Figure 1B:
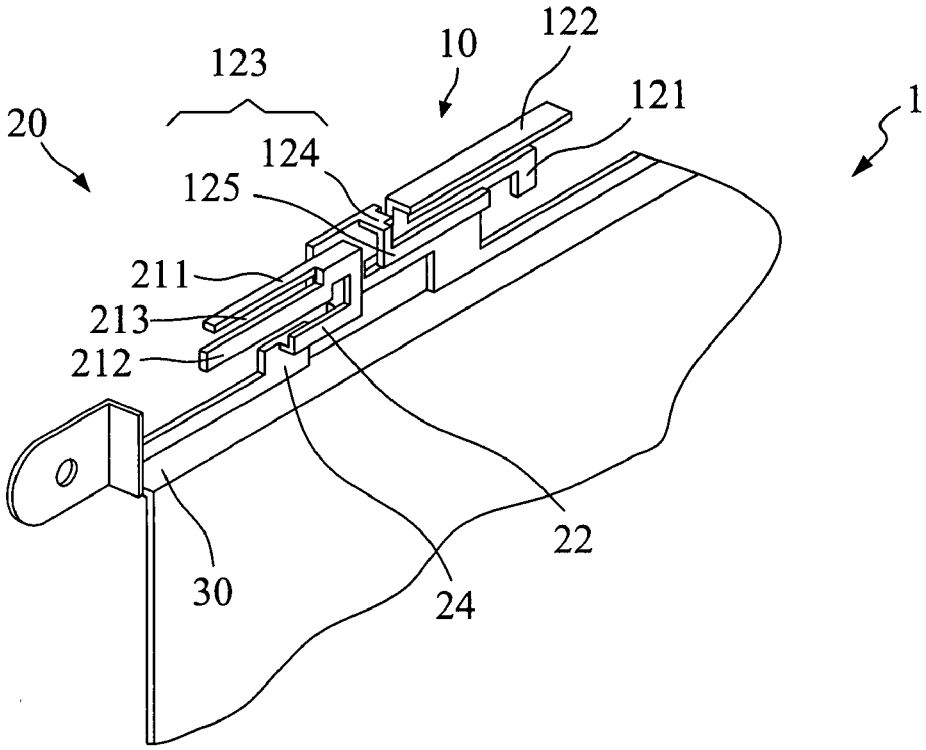

Please refer to FIGS. 1(*a*), (*b*). FIGS. 1(*a*), (*b*) are front and back view drawings of a first embodiment of the present invention. As shown in FIGS. 1(*a*), (*b*), a triple-band antenna 1 of the present invention comprises a first radiating body 10, a second radiating body 20 and a signal feed source 40. The first radiating body 10 comprises a first metal element 11, a first radiating unit 12, a first connecting element 13 and a first grounded wall 14. The first metal element 11 comprises a feed point 111. The first metal element 11 is connected to the first radiating unit 12, and the first radiating unit 12 substantially extends along a first direction. One end of the first connecting element 13 is connected to the first metal element 11, and the other end is connected to the first grounded wall 14. The second radiating body 20 partially overlaps the first radiating body 10 and has no contact thereto, which reduces the entire volume of the triple-band antenna 1. The second radiating body 20 comprises a second radiating unit 21, a second connecting element 22, a grounded connecting element 23 and a second grounded wall 24. The second radiating unit 21 substantially extends along a second direction, and one end of the second connecting element 22 is connected to the second radiating unit 21, while the other end is connected to the second grounded wall 24 via the grounded connecting element 23. The signal feed source 40 is connected to the feed point 111. The triple-band antenna 1 further comprises a metal base 30, and the metal base 30 is substantially perpendicularly connected to the first grounded wall 14 and the second grounded wall 24. A positive electrode of the signal feed source 40 is connected to the feed point 111, and a negative electrode of the signal feed source 40 is connected to the metal base 30.

The first radiating unit 12 comprises a second metal element 121, a third metal element 122 and a fourth metal element 123. The second metal element 121 has an L-shaped structure and is in the same plane as the first metal element 11; the third metal element 122 and the first metal element 11 are substantially perpendicularly connected to each other; the fourth metal element 123 comprises a first plane 124 and a second plane 125. The first plane 124 and the first metal element 11 are substantially perpendicularly connected to each other. The second plane 125 has an L-shaped structure and is substantially perpendicularly connected to the first plane 124. The second radiating unit 21 comprises a fifth metal element 211 and a sixth metal element 212. The fifth metal element 211 and the sixth metal element 212 are substantially perpendicularly connected to each other; and the sixth metal element 212 and the second connecting element 22 are in the same plane. A rectangular slot 213 is disposed between the fifth metal element 211 and the sixth metal element 212.

With the above-mentioned design, the first radiating body 10 provides a double-band broadband antenna for a high frequency band and a low frequency band. The second metal element 121 can be operated in the lowest frequency band, while the third metal element 122 can be operated in a sub-low frequency band, and so the second metal element 121 and the third metal element 122 can be combined into a low frequency band broadband antenna. The first metal element 11 can be operated in a high frequency band to form a high frequency band antenna. The extension lengths of the second metal element 121 and the third metal element 122 are adjustable in order to control the width of the corresponding frequency bands. In this embodiment, the extension length of the second metal element 121 is smaller than the extension length of the third metal element 122. The extension length of the second metal element 121 from the feed point 111 is substantially one quarter of a central frequency wavelength of a low frequency band (which is about 2.3 GHz-2.5 GHz), and the extension length of the third metal element 122 from the feed point 111 is substantially one quarter of a central frequency wavelength of a sub-low frequency band (which is about 2.5 GHz-2.7 GHz). The extension lengths of the second metal element 121 and the third metal element 122 can be exchanged with each other, and their corresponding frequency bands are then also exchanged with each other. In addition, the L-shaped section of the extension end of the second metal element 121 is kept at a distance from the first grounded wall 14, and this distance can be adjusted to change a capacitance value to adjust the impedance of the low frequency band.

To combine the first radiating body 10 and the second radiating body 20, an antenna for an intermediate frequency band is formed. The fourth metal element 123 and the sixth metal element 212 form an intermediate frequency dipole antenna, and the second metal element 121, the fourth metal element 123 and the fifth metal element 211 form a sub-intermediate frequency near dipole antenna. The extension length of the fifth metal element 211 is smaller than the extension length of the sixth metal element 212, and these extension lengths can be adjustable with respect to each other to control the widths of the corresponding frequency bands. In this embodiment, the extension length of the fifth metal element 211 from the feed point 111 is substantially one quarter of a central frequency wavelength of a higher frequency part of an intermediate frequency band (which is about 3.55 GHz-3.8 GHz). The extension length of the sixth metal element 212 from the feed point 111 is substantially one quarter of a central frequency wavelength of a sub-high frequency part of an intermediate frequency band (which is about 3.3 GHz-3.55 GHz). The extension lengths of the fifth metal element 211 and the sixth metal element 212 can be exchanged with each other, and then their corresponding frequency bands are also exchanged with each other.

As shown in FIGS. 1(*a*), (*b*), the metal base 30 is connected to a grounded element 50 for providing grounding for the triple-band antenna 1. The grounded element 50 may be a housing of the electronic device, a metal sheet or an elastic metallic material. The metal base 30 further comprises a fastening structure 31. The fastening structure 31 is disposed on two sides of the metal base 30 and used for fastening the triple-band antenna 1 to the electronic device. In this embodiment, the fastening structure 31 is a threaded fastening element, but other equivalent fastening elements may also be suitable.

Figure 2:
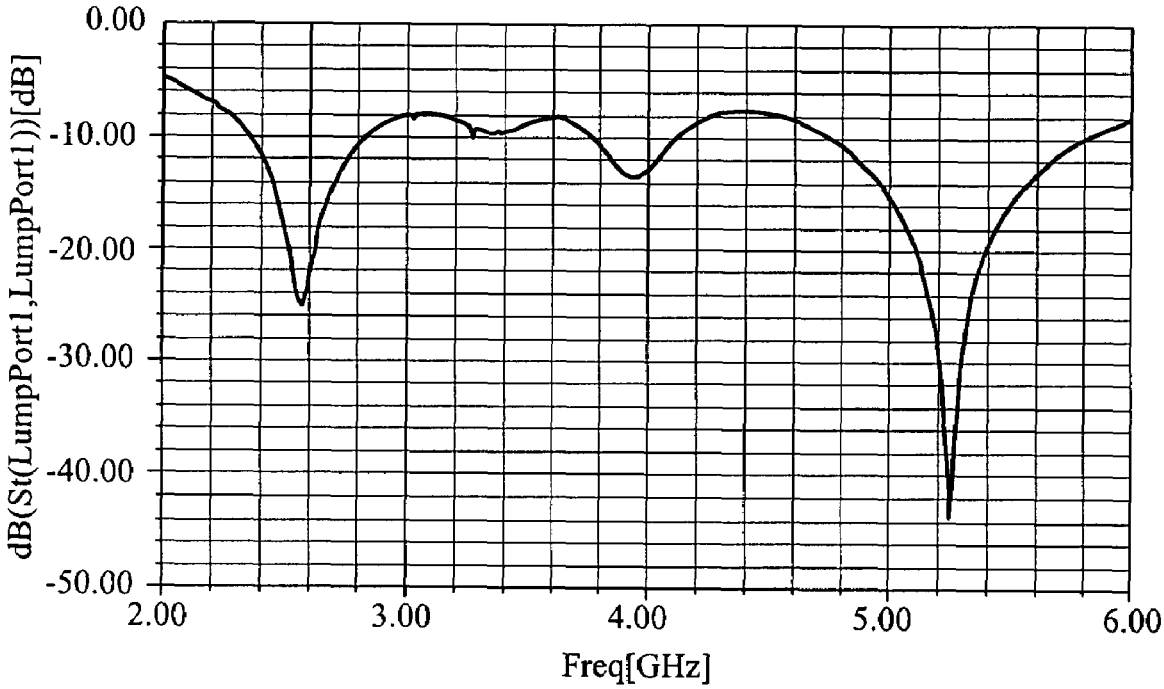
FIG. 2 is a drawing showing return loss measurement results of the first embodiment of the present invention.

Please refer to FIG. 2. FIG. 2 is a drawing showing return loss measurement results of the first embodiment of the present invention. As shown in FIG. 2, the triple-band antenna 1 not only provides the low frequency broadband band and the high frequency broadband band, but also provides the intermediate frequency narrow band between 3.8 GHz to 4.1 GHz to achieve the triple-band antenna requirement.

Figure 3A:
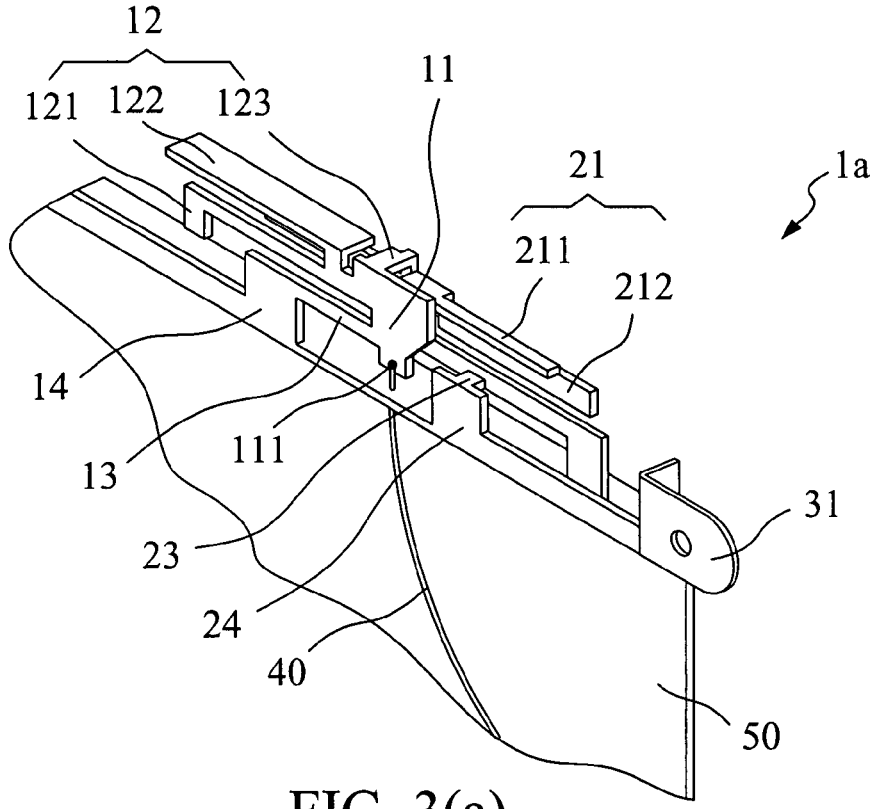
FIGS. 3(*a*), (*b*) are front and back view drawings of a second embodiment of the present invention.
Figure 3B:
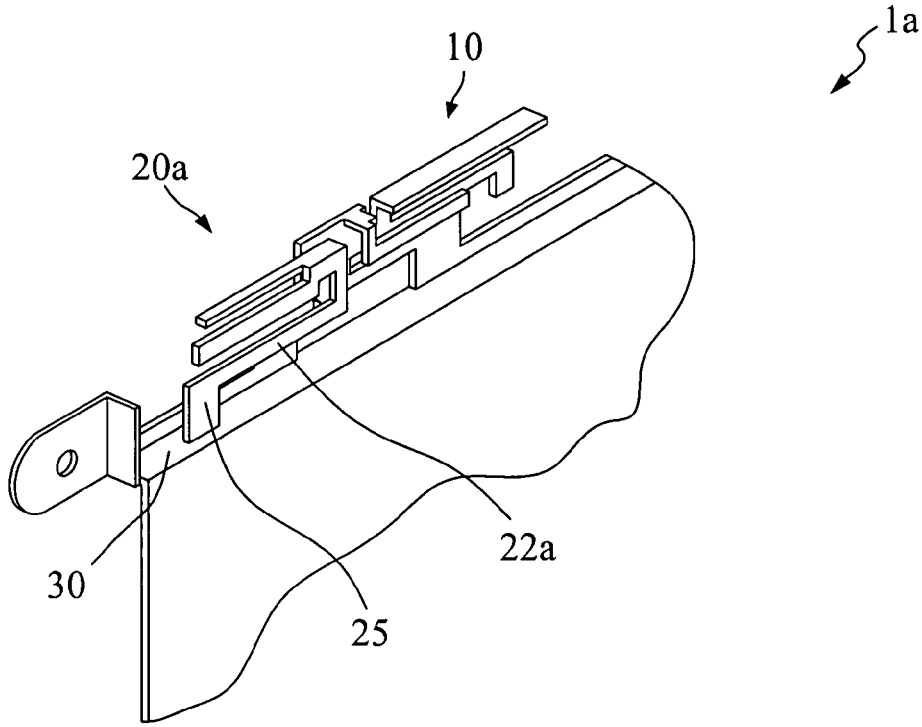

Please refer to FIGS. 3(*a*), (*b*). FIGS. 3(*a*), (*b*) are front and back view drawings of a second embodiment of the present invention. As shown in FIG. 3(*a*), (*b*), in a second embodiment of the present invention, a difference between the triple-band antenna 1*a* and the triple-band antenna 1 in the first embodiment is that the second radiating body 20*a* further comprises a third grounded wall 25 and a second connecting element 22*a*. One end of the third grounded wall 25 is substantially perpendicularly connected to the metal base 30, and the second connecting element 22*a* extends along the second direction and is connected to another end of the third grounded wall 25.

With the above-mentioned design, the first connecting element 13, the first grounded wall 14, the second connecting element 22*a*, the grounded connecting element 23 and the third grounded wall 25 form a balun for the intermediate frequency band via a connection provided by the signal feed source 40. With the balun, the impedance of the intermediate frequency dipole antenna and the sub-intermediate frequency near dipole antenna can be adjusted to increase the frequency band to provide the functionality of an intermediate frequency broadband antenna. The second radiating body 20, the first metal element 11, the fourth metal element 123, the first connecting element 13 and the first grounded wall 14 form a near dipole broadband antenna for the intermediate frequency band with the balun, which provides an adjustable impedance for increasing the frequency band via the balun.

Figure 4:
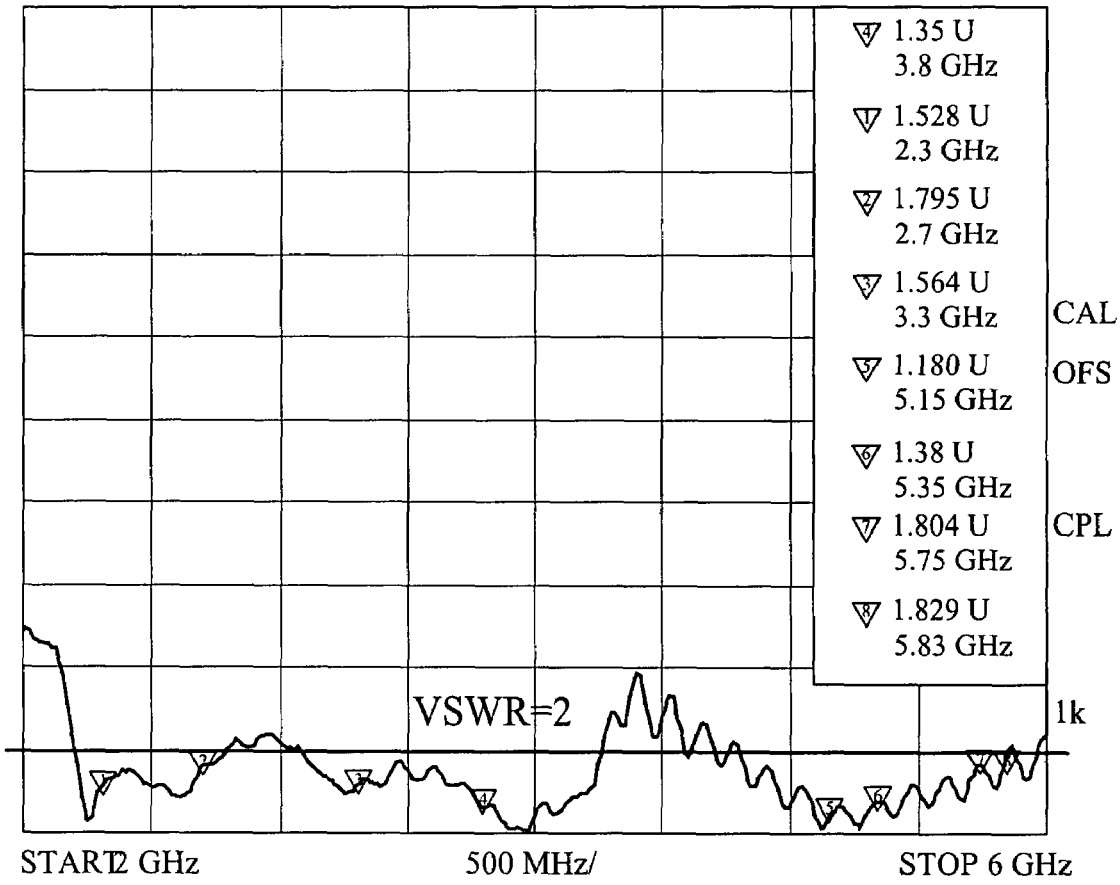
FIG. 4 shows voltage standing wave ratio (VSWR) measurement results of the second embodiment.

Please refer to FIG. 4. FIG. 4 shows voltage standing wave ratio (VSWR) measurement results of the second embodiment. As shown in FIG. 4, at the low frequency band from 2.3 GHz to 2.7 GHz, the intermediate frequency band from 3.3 GHz to 3.8 GHz, and the high frequency band from 5 GHz to 6 GHz, the triple-band antenna 1*a* has a VSWR value that is smaller than 2, and so the triple-band antenna 1*a* can provide broadband functions in low, intermediate, and high frequency bands. In this embodiment, a bandwidth of the low frequency band can reach to about 450 MHz, which enhances the functionality of the low frequency broadband band.

Figure 5:
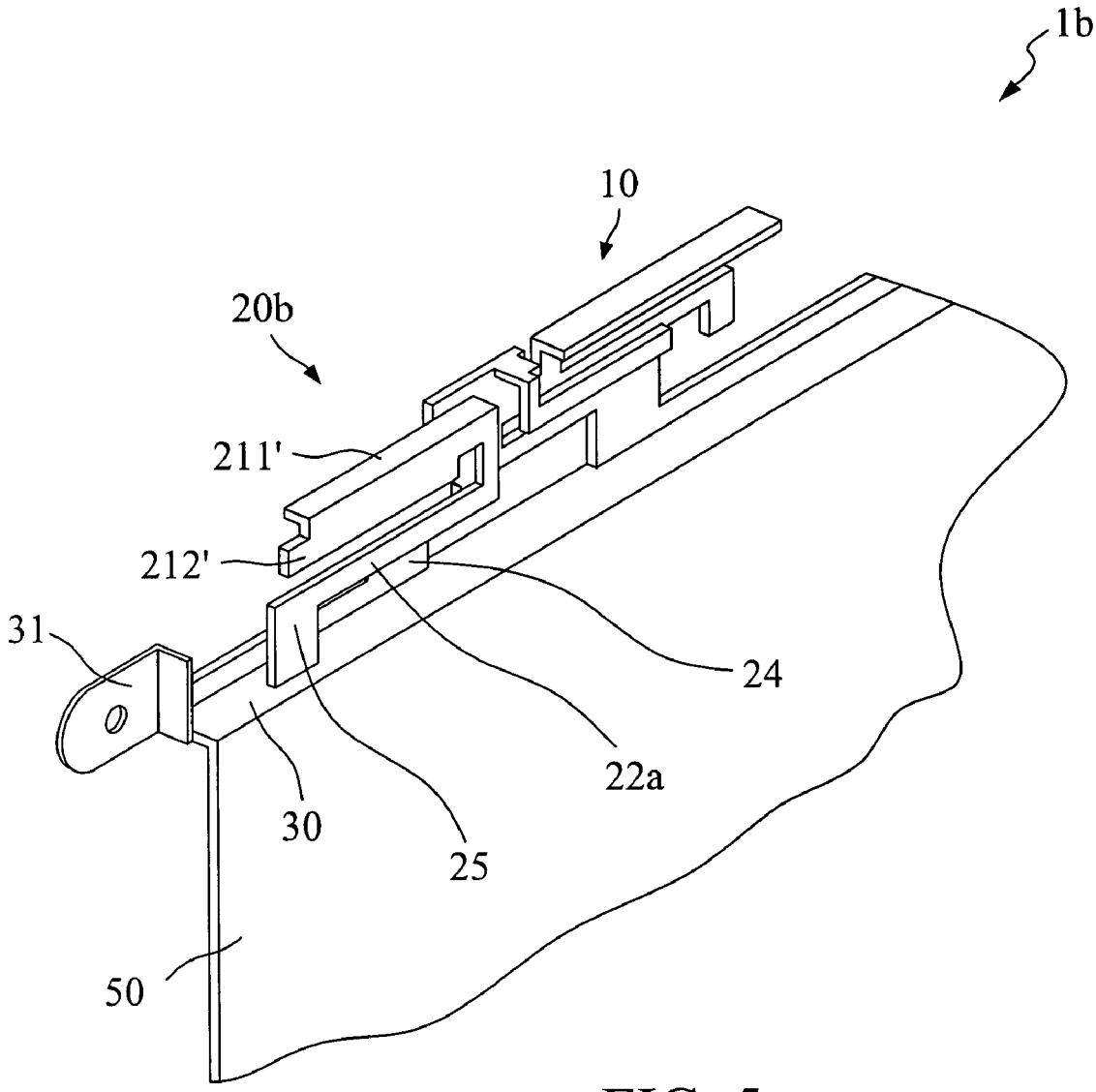
FIG. 5 is a back view drawing of a third embodiment of the present invention.
Figure 6:
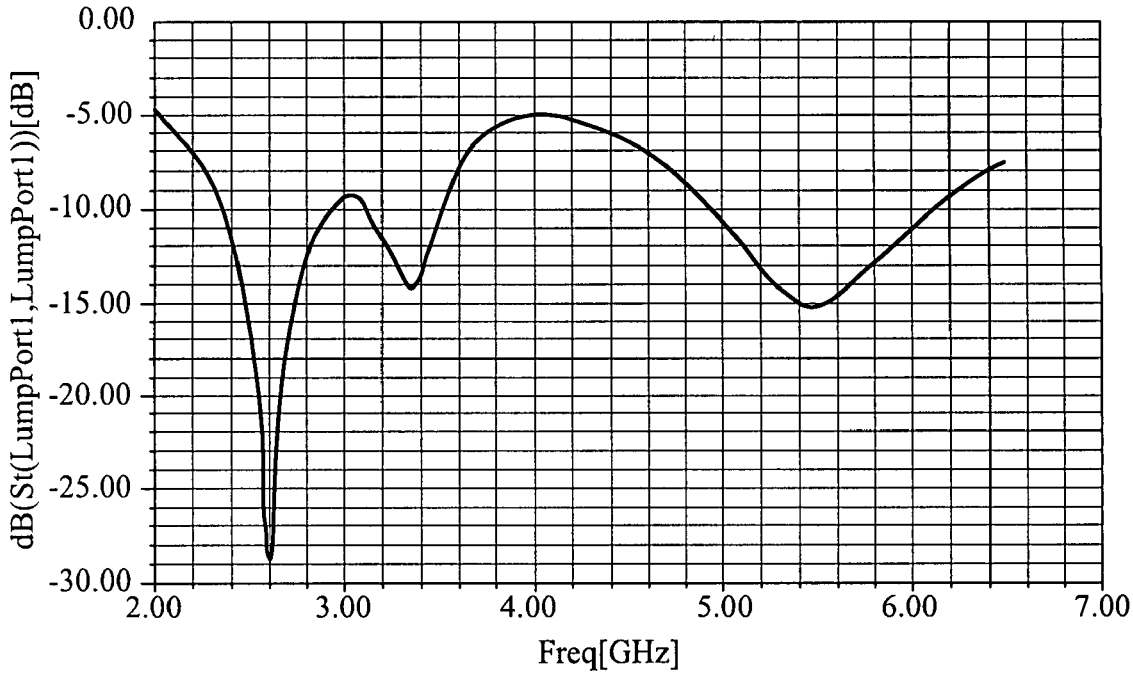
FIG. 6 is a drawing showing return loss measurement results of the third embodiment of the present invention.

Please refer to FIG. 5 and FIG. 6. FIG. 5 is a back view drawing of a third embodiment of the present invention. FIG. 6 is a drawing showing return loss measurement results of the third embodiment of the present invention. As shown in FIG. 5, compared to the triple-band antenna 1*a* in the second embodiment, in a third embodiment of the present invention the rectangular slot 213 disposed between the fifth metal element 211' and the sixth metal element 212' is filled, but the fifth metal element 211' and the sixth metal element 212' of the second radiating body 20*b* are still substantially perpendicularly connected to each other. With the above-mentioned design, the single resonance mode of the antenna in the intermediate frequency band is affected, and an intermediate frequency narrow band antenna is formed. As shown in FIG. 6, this intermediate frequency narrow band antenna provides an intermediate frequency narrow band from 3.1 GHz to 3.5 GHz.

Figure 7A:
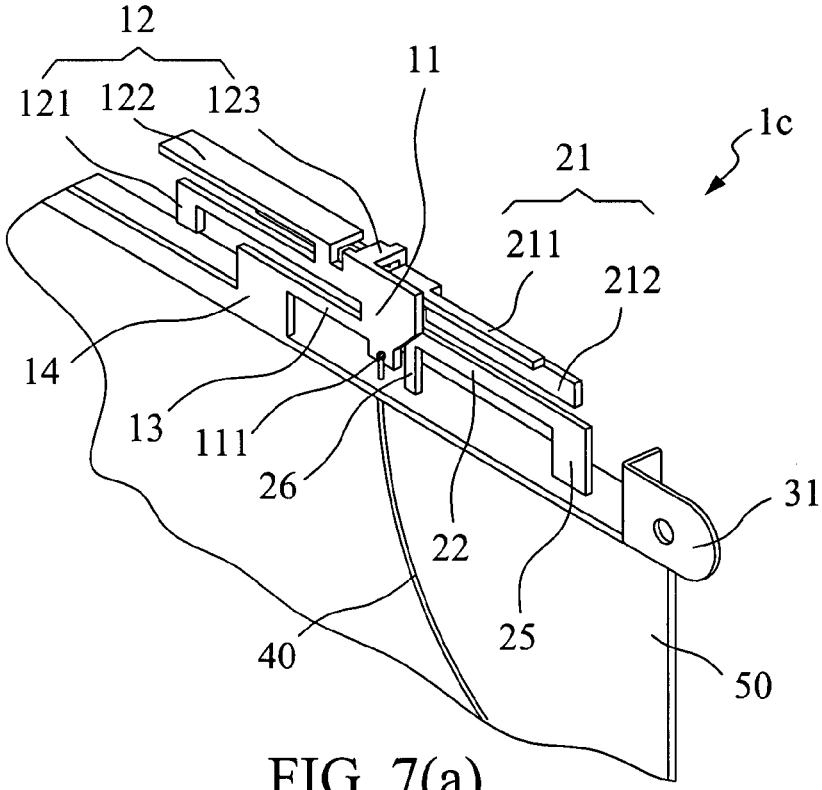
FIGS. 7(*a*), (*b*) are front and back view drawings of a fourth embodiment of the present invention.
Figure 7B:
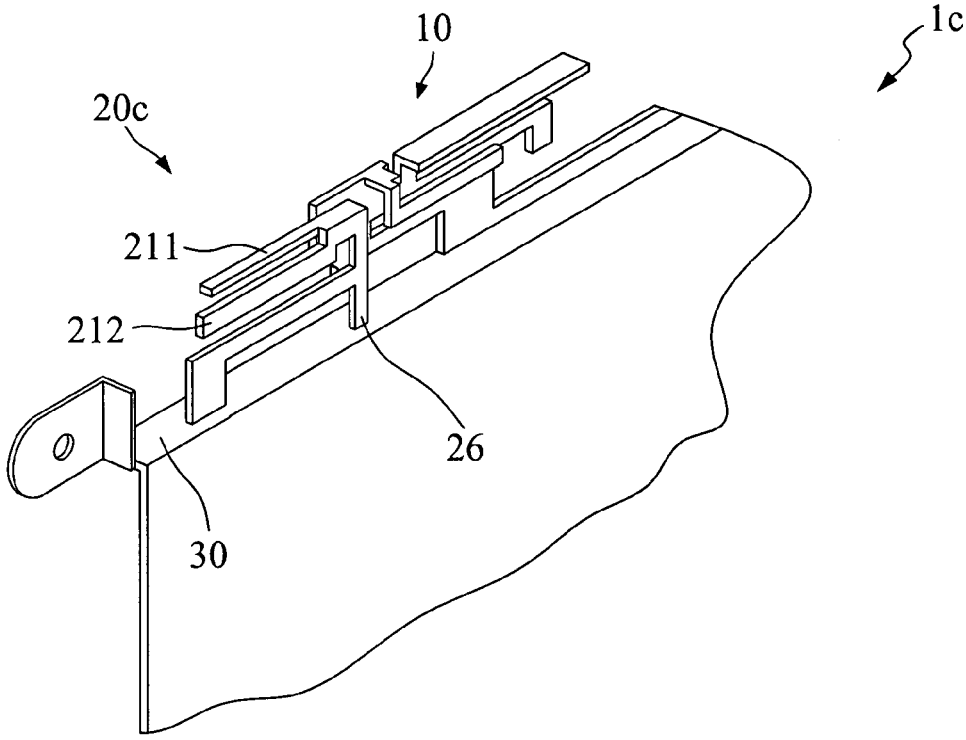
Figure 8:
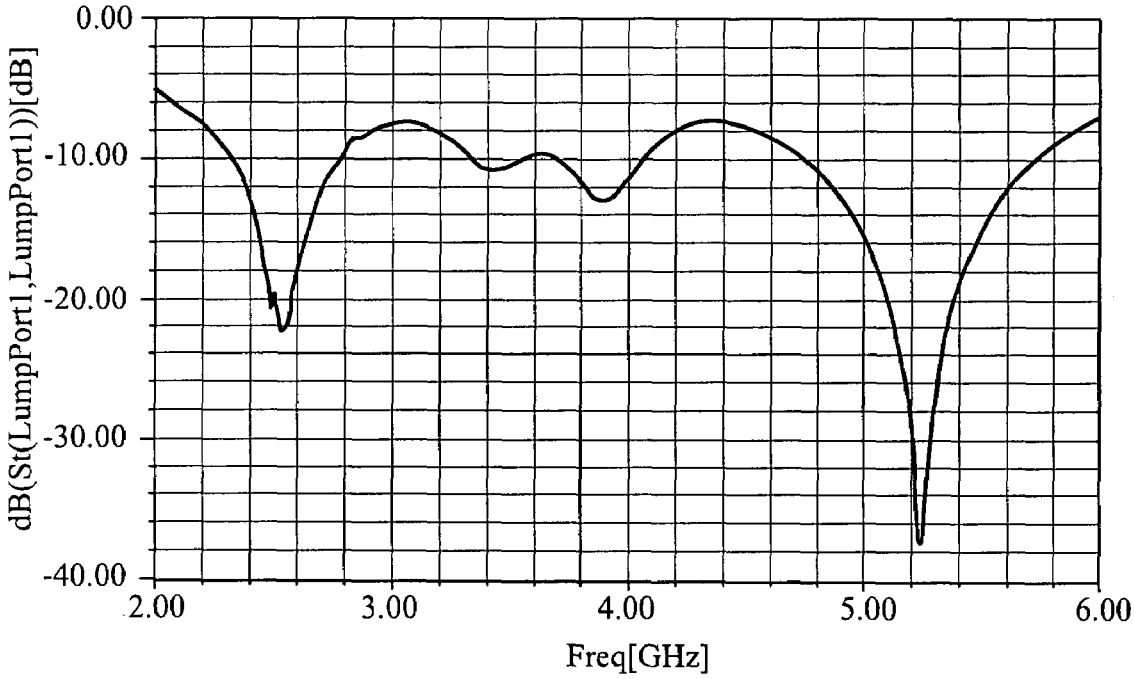
FIG. 8 is a drawing showing return loss measurement results of the fourth embodiment of the present invention.

Please refer to FIGS. 7(*a*), (*b*) and FIG. 8. FIGS. 7(*a*), (*b*) are front and back view drawings of a fourth embodiment of the present invention. FIG. 8 is a drawing showing return loss measurement results of the fourth embodiment of the present invention. As shown in FIGS. 7(*a*), (*b*), a triple-band antenna 1*c* in a fourth embodiment comprises the first radiating body 10, the second radiating body 20*c* and the signal feed source 40. The first radiating body 10 comprises a first metal element 11, a first radiating unit 12, a first connecting element 13 and a first grounded wall 14. The first metal element 11 comprises a feed point 111. The first metal element 11 is connected to the first radiating unit 12, and the first radiating unit 12 substantially extends along a first direction. One end of the first connecting element 13 is connected to the first metal element 11, and the other end is connected to the first grounded wall 14. The second radiating body 20*c* comprises a second radiating unit 21, a second connecting element 22, a third grounded wall 25 and a fourth grounded wall 26. The second radiating unit 21 substantially extends along a second direction, and one end of the second connecting element 22 is connected to the second radiating unit 21 and the fourth grounded wall 26, and the other end is connected to the third grounded wall 25. The signal feed source 40 is connected to the feed point 111. The triple-band antenna 1*c* further comprises a metal base 30, and the metal base 30 is substantially perpendicularly connected to the first grounded wall 14, the third grounded wall 25 and the fourth grounded wall 26, and the signal feed source 40 is also connected to the metal base 30. In this embodiment, the second radiating body 20*c* partially overlaps the first radiating body 10 and has no contact thereto. As shown in FIG. 8, the triple-band antenna 1*c* has a low frequency band from 2.3 GHz to 2.7 GHz, an intermediate frequency band from 3.3 GHz to 3.8 GHz, and a high frequency band from 4.8 GHz to 5.8 GHz.

Figure 9:
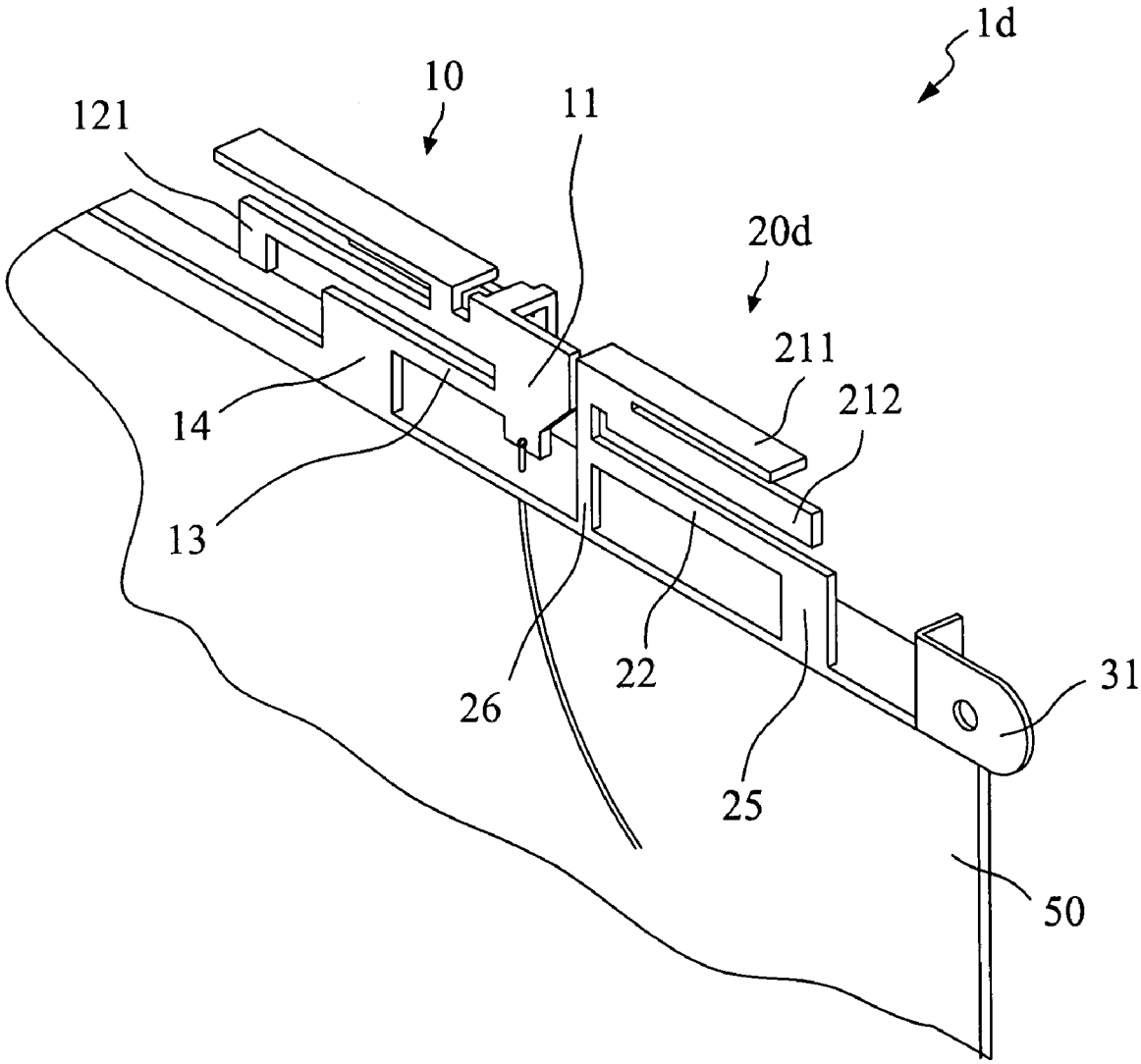
FIG. 9 is a front view drawing of a fifth embodiment of the present invention.
Figure 10:
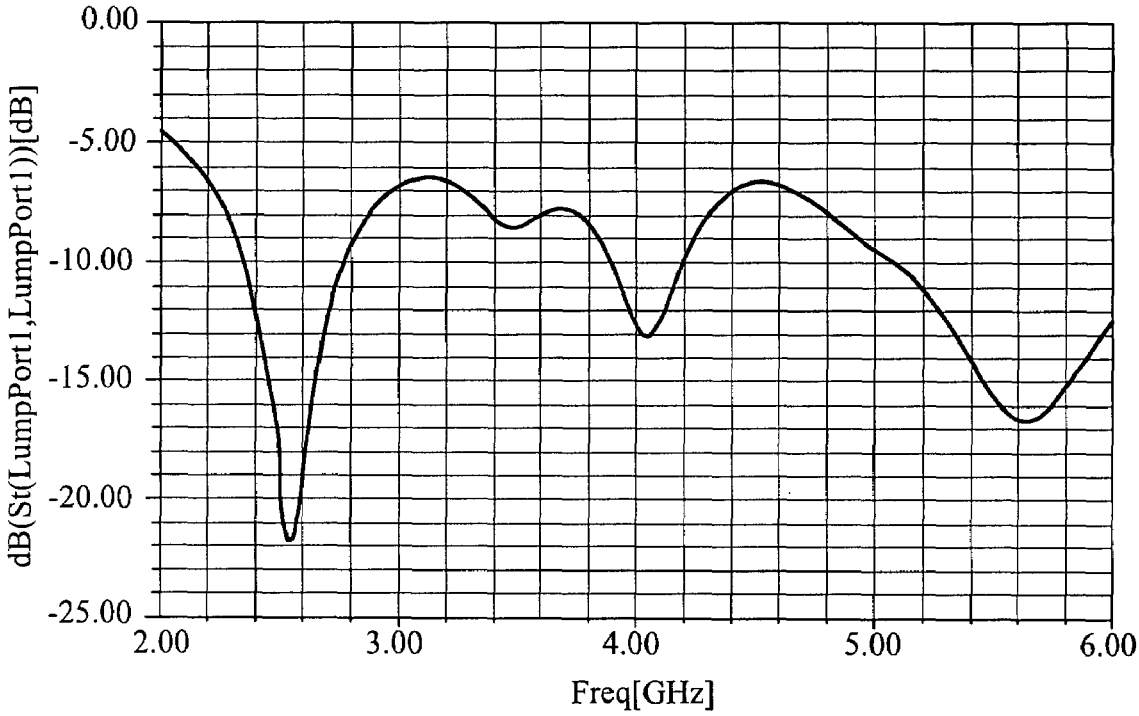
FIG. 10 is a drawing showing return loss measurement results of the fifth embodiment of the present invention.

Please refer to FIG. 9 and FIG. 10. FIG. 9 is a front view drawing of a fifth embodiment of the present invention. FIG. 10 is a drawing showing return loss measurement results of the fifth embodiment of the present invention. As shown in FIG. 9, compared to the triple-band antenna 1*c* in the fourth embodiment, a triple-band antenna 1*d* in a fifth embodiment has the first radiating body 10 and the second radiating body 20*d* disposed in the same plane, which is substantially perpendicular to the metal base 30, and there is no contact between these two. The first metal element 11, the second metal element 121, the sixth metal element 212, the first connecting element 13, the second connecting element 22, the first grounded wall 14, the third grounded wall 25 and the fourth grounded wall 26 are all in the same plane. With this design, most elements of the triple-band antenna 1*d* are disposed in the same plane to reduce the thickness of the triple-band antenna 1*d*; an integrated structure may be employed in the triple-band antenna 1*d* for a more simplified manufacturing process. Additionally, this design provides the triple-band antenna 1*d* with a different intermediate frequency band range.

Figure 11:
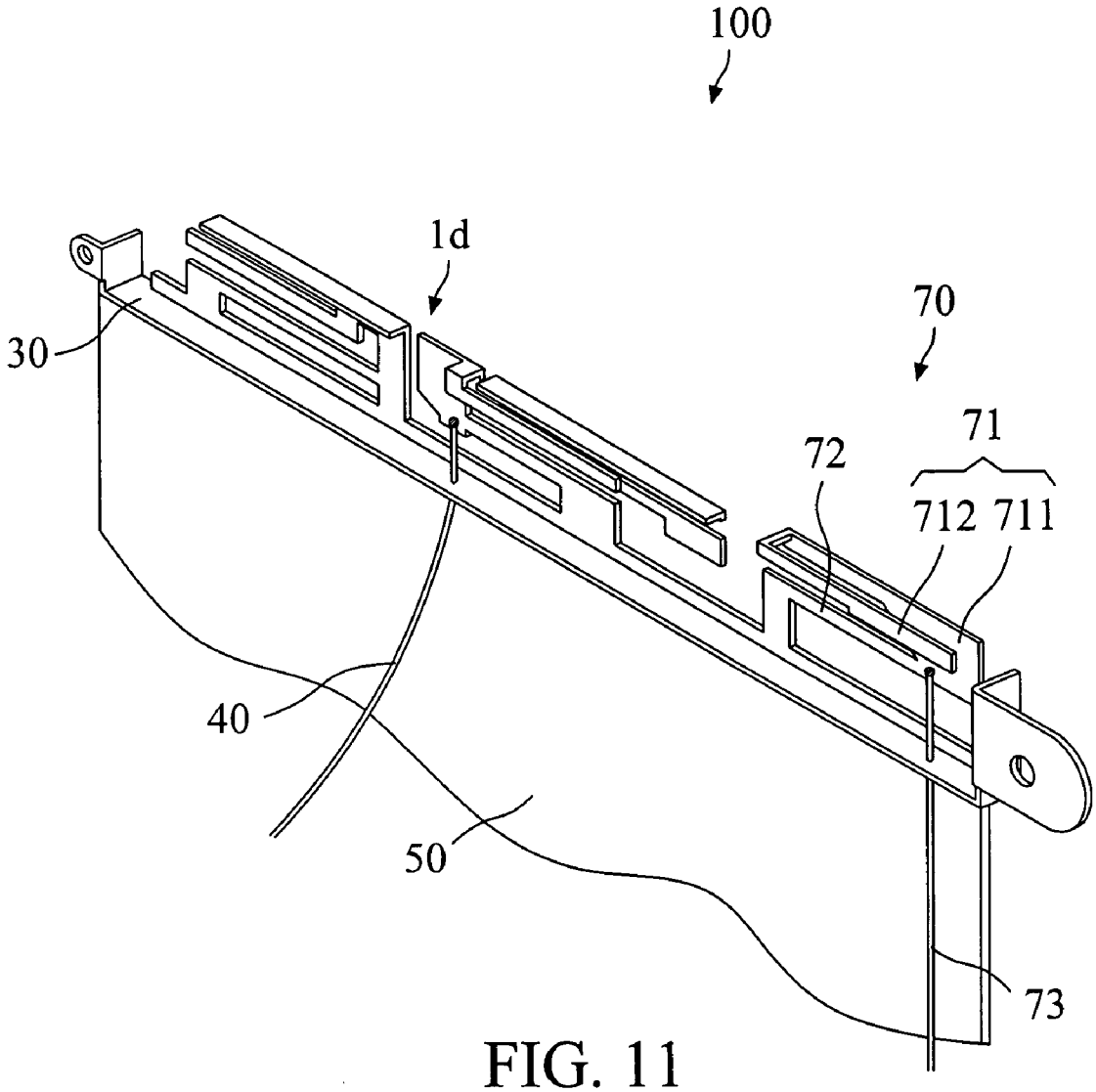
FIG. 11 is a schematic drawing of an antenna module according to the present invention.

Please refer to FIG. 11. FIG. 11 is a schematic drawing of an antenna module according to the present invention. As shown in FIG. 11, an antenna module 100 comprises the triple-band antenna 1*d* and a dual-band antenna 70. The dual-band antenna 70 comprises a radiating element 71, a connecting element 72 and a second signal feed source 73. The radiating element 71 comprises a high frequency band radiating unit 711 and a low frequency band radiating unit 712; the low frequency band radiating unit 712 has a three-dimensional structure formed by bending the high frequency band radiating unit 711 upward, and this three-dimensional structure is U-shaped. One end of the connecting element 72 is connected to the radiating element 71, and the second signal feed source 73 is also connected to the radiating element 71. The antenna module 100 further comprises a metal base 30. The metal base 30 is substantially perpendicularly connected to the triple-band antenna 1*d* and the dual-band antenna 70, and the signal feed source 40 and the second signal feed source 73 are connected to the metal base 30. In this embodiment, the triple-band antenna 1*d* and the dual-band antenna 70 are located in the same plane that is substantially perpendicular to the metal base 30. The metal base 30 and the grounded element 50 are substantially perpendicularly connected to each other. The triple-band antenna 1*d*, the dual-band antenna 70, the metal base 30 and the grounded element 50 may be an integrated structure. Since the triple-band antenna 1*d* has WiMAX and WiFi functionalities, and as the dual-band antenna 70 has WiFi functionality, when the two are combined to form the antenna module 100 and another triple-band antenna 1*d* is added, the present invention supports the wireless communication MIMO (multiple input multiple output) technology. Furthermore, based upon different installation spaces and requirements, the triple-band antenna 1*d* can be replaced by the triple-band antenna 1, 1*a*, 1*b*, 1*c* in the above-mentioned embodiments. In the antenna module 100, one of the triple-band antennas 1, 1*a*, 1*b*, 1*c*, 1*d* can also be replaced by the dual-band antenna 70 to form an antenna combination having WiMAX and WiFi functionalities.

Figure 12:
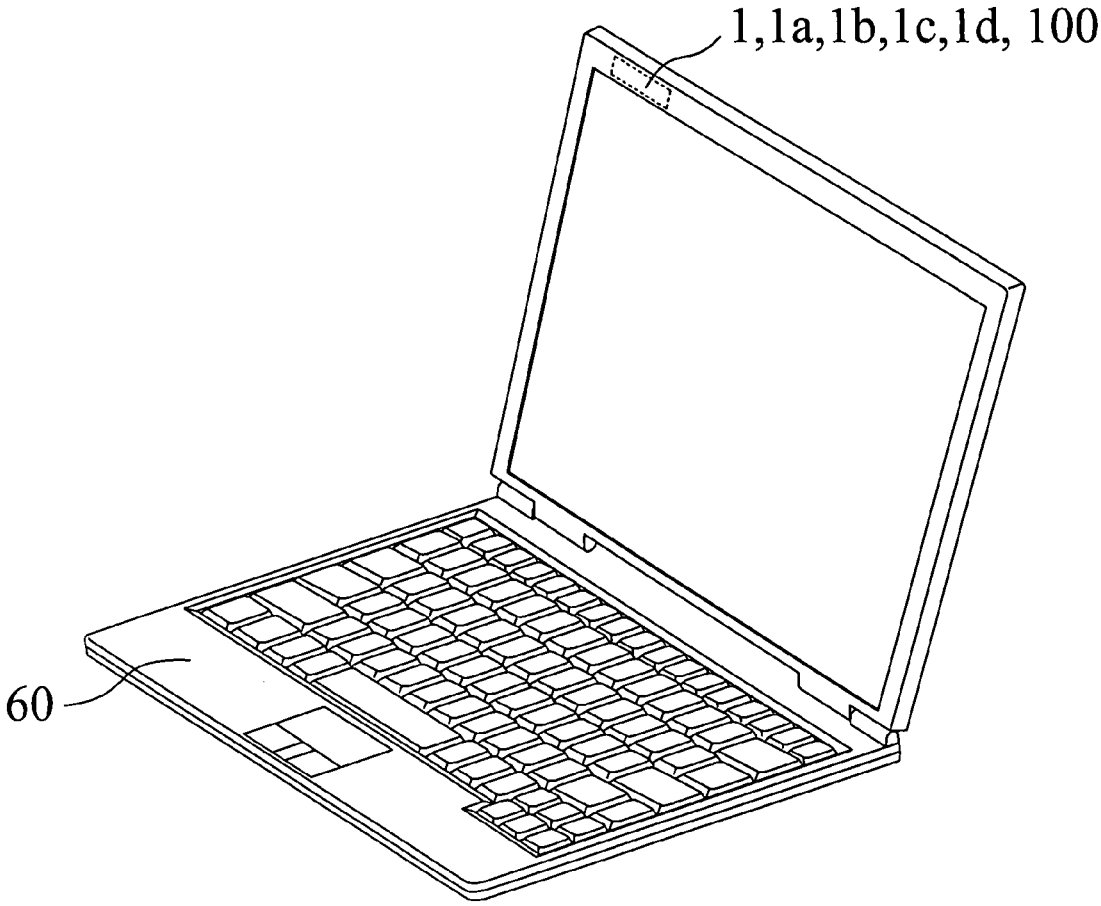
FIG. 12 is a schematic drawing illustrating the present invention in combination with an electronic device.

Please refer to FIG. 12. FIG. 12 is a schematic drawing of combining the present invention together with an electronic device. As shown in FIG. 12, the triple-band antennas 1, 1*a*, 1*b*, 1*c*, 1*d* or the antenna module 100 can be disposed in an electronic device 60 to provide the electronic device 60 with wireless communications functionality. Since the triple-band antenna 1, 1*a*, 1*b*, 1*c*, 1*d* or the antenna module 100 has a small volume, and they can be directly disposed in the electronic device 60 to avoid external form factors. The triple-band antennas 1, 1*a*, 1*b*, 1*c*, 1*d* or the antenna module 100 can be applied in various electronic devices 60, such as a notebook, a mobile phone, or a PDA.

Although the present invention has been explained in relation to its preferred embodiments, it is to be understood that many other possible modifications and variations can be made without departing from the spirit and scope of the invention as hereinafter claimed.

What is claimed is:

1. A triple-band antenna for an electronic device with a wireless communication capability comprising:

a first radiating body comprising a first metal element, a first radiating unit, a first connecting element and a first grounded wall, the first metal element comprising a feed point, the first metal element being connected to the first radiating unit, the first radiating unit substantially extending along a first direction, one end of the first connecting element being connected to the first metal element, and the other end being connected to the first grounded wall; and a second radiating body partially overlapping the first radiating body and having no contact thereto, the second radiating body comprising a second radiating unit, a second connecting element, a grounded connecting element and a second grounded wall, the second radiating unit substantially extending along a second direction, one end of the second connecting element being connected to the second radiating unit, the other end being connected to the second grounded wall via the grounded connecting element.

2. The triple-band antenna as claimed in claim 1, wherein the triple-band antenna further comprises a metal base and a signal feed source; wherein the metal base is substantially perpendicularly connected to the first grounded wall and the second grounded wall, and one end of the signal feed source is connected to the feed point, and the other end is connected to the metal base.

3. The triple-band antenna as claimed in claim 1, wherein the first radiating unit comprises a second metal element, a third metal element and a fourth metal element, the second metal element having an L-shaped structure and in the same plane as the first metal element; wherein the third metal element and the first metal element are substantially perpendicularly connected to each other, the fourth metal element comprising a first plane and a second plane, the first plane and the first metal element being substantially perpendicularly connected to each other, and the second plane having an L-shaped structure and being substantially perpendicularly connected to the first plane.

4. The triple-band antenna as claimed in claim 3, wherein the second radiating unit comprises a fifth metal element and a sixth metal element, the fifth metal element and the sixth metal element being substantially perpendicularly connected to each other, and the sixth metal element being in the same plane as the second connecting element.

5. The triple-band antenna as claimed in claim 1, wherein the second radiating body further comprises a third grounded wall, and the second connecting element extends along the second direction and is connected to one end of the third grounded wall.

6. The triple-band antenna as claimed in claim 5, wherein the first connecting element, the first grounded wall, the second connecting element, the grounded connecting element and the third grounded wall form a balun for the intermediate frequency band via a connection provided by the signal feed source.

7. The triple-band antenna as claimed in claim 4, wherein a rectangular slot is disposed between the fifth metal element and the sixth metal element.

8. The triple-band antenna as claimed in claim 3, wherein an extension length of the second metal element is substantially one quarter of a central frequency wavelength of a low frequency band.

9. The triple-band antenna as claimed in claim 3, wherein an extension length of the third metal element is substantially one quarter of a central frequency wavelength of a sub-low frequency band.

10. The triple-band antenna as claimed in claim 4, wherein an extension length of the fifth metal element is substantially one quarter of a central frequency wavelength of a higher frequency part of an intermediate frequency band.

11. The triple-band antenna as claimed in claim 4, wherein an extension length of the sixth metal element is substantially one quarter of a central frequency wavelength in a sub-high frequency part of an intermediate frequency band.

12. The triple-band antenna as claimed in claim 1 further comprising a grounded element.

13. An electronic device with a wireless communication capability comprising:

an antenna module comprising:

the triple-band antenna as claimed in claim 1; and a dual-band antenna comprising:

a radiating element comprising a high frequency band radiating unit and a low frequency band radiating unit; wherein the low frequency band radiating unit has a three-dimensional structure formed by bending the high frequency band radiating unit upwards; and a connecting element, one end of the connecting element being connected to the radiating element.

14. A triple-band antenna for an electronic device with a wireless communication capability comprising:

a first radiating body comprising a first metal element, a first radiating unit, a first connecting element and a first grounded wall, the first metal element comprising a feed point, the first metal element being connected to the first radiating unit, the first radiating unit substantially extending along a first direction, one end of the first connecting element being connected to the first metal element, and the other end being connected to the first grounded wall; and a second radiating body comprising a second radiating unit, a second connecting element, a third grounded wall and a fourth grounded wall, the second radiating unit substantially extending along a second direction, one end of the second connecting element being connected to the second radiating unit and the fourth grounded wall, the other end being connected to the third grounded wall.

15. The triple-band antenna as claimed in claim 14, wherein the triple-band antenna further comprises a metal base and a signal feed source, the metal base being substantially perpendicularly connected to the first grounded wall, the third grounded wall and the fourth grounded wall, one end of the signal feed source being connected to the feed point, and the other end being connected to the metal base.

16. The triple-band antenna as claimed in claim 14, wherein the second radiating body and the first radiating body partially overlap and have no contact with each other.

17. The triple-band antenna as claimed in claim 14, wherein the first radiating unit comprises a second metal element, a third metal element and a fourth metal element, the second metal element having an L-shaped structure and in the same plane as the first metal element, the third metal element and the first metal element being substantially perpendicularly connected with each other; wherein the fourth metal element comprises a first plane and a second plane, the first plane and the first metal element being substantially perpendicularly connected to each other, and the second plane having an L-shaped structure and being substantially perpendicularly connected to the first plane.

18. The triple-band antenna as claimed in claim 17, wherein the second radiating unit comprises a fifth metal element and a sixth metal element, the fifth metal element and the sixth metal element being substantially perpendicularly connected to each other, and a rectangular slot being disposed between the fifth metal element and the sixth metal element, the sixth metal element being in the same plane as the second connecting element.

19. The triple-band antenna as claimed in claim 17, wherein an extension length of the second metal element is substantially one quarter of a central frequency wavelength in a low frequency band.

20. The triple-band antenna as claimed in claim 17, wherein an extension length of the third metal element is substantially one quarter of a central frequency wavelength in a sub-low frequency band.

21. The triple-band antenna as claimed in claim 18, wherein an extension length of the fifth metal element is substantially one quarter of a central frequency wavelength in a higher frequency part of an intermediate frequency band.

22. The triple-band antenna as claimed in claim 18, wherein an extension length of the sixth metal element is substantially one quarter of a central frequency wavelength in a sub-high frequency part of an intermediate frequency band.

23. The triple-band antenna as claimed in claim 14 further comprising a grounded element.

24. An electronic device with a wireless communication capability comprising:

a triple-band antenna comprising:

a first radiating body comprising a first metal element, a first radiating unit, a first connecting element and a first grounded wall, the first metal element having a feed point, the first metal element being connected to the first radiating unit, the first radiating unit substantially extending along a first direction, one end of the first connecting element being connected to the first metal element, and the other end being connected to the first grounded wall; and a second radiating body partially overlapping the first radiating body and having no contact thereto, the second radiating body comprising a second radiating unit, a second connecting element, a grounded connecting element and a second grounded wall, the second radiating unit substantially extending along a second direction, one end of the second connecting element being connected to the second radiating unit, and the other end being connected to the second grounded wall via the grounded connecting element.

25. An electronic device with a wireless communication capability comprising:

a triple-band antenna comprising:

a first radiating body comprising a first metal element, a first radiating unit, a first connecting element and a first grounded wall, the first metal element comprising a feed point, the first metal element being connected to the first radiating unit, the first radiating unit substantially extending along a first direction, one end of the first connecting element being connected to the first metal element, and the other end being connected to the first grounded wall; and a second radiating body comprising a second radiating unit, a second connecting element, a third grounded wall and a fourth grounded wall, the second radiating unit substantially extending along a second direction, one end of the second connecting element being connected to the second radiating unit and the fourth grounded wall, the other end connected to the third grounded wall.

* * * * *